US005169277A

United States Patent [19]

Orser et al.

[11] Patent Number: 5,169,277

[45] Date of Patent: Dec. 8, 1992

[54] LIFT ARM LOCK DOWN APPARATUS AND METHOD

[75] Inventors: Lloyd Orser; Claude Dubé, both of Centreville, Canada

[73] Assignee: Thomas Equipment Ltd., New Brunswick, Canada

[21] Appl. No.: 668,934

[22] Filed: Mar. 13, 1991

[30] Foreign Application Priority Data

Jan. 29, 1991 [CA] Canada ..... 2035210

[51] Int. Cl.[5] ..... E02F 3/16

[52] U.S. Cl. ..... 414/685; 292/256.75; 212/229

[58] Field of Search ..... 414/685, 686, 680; 292/256.75; 212/229

[56] References Cited

U.S. PATENT DOCUMENTS

| | | | |
|---|---|---|---|
| 3,662,653 | 5/1972 | Carlson et al. | 92/15 |
| 3,672,715 | 6/1972 | Carson | 292/256.75 X |
| 3,995,761 | 12/1976 | Hurlburt | 414/713 |
| 4,073,345 | 2/1978 | Miller | 172/413 |
| 4,122,758 | 10/1978 | Bieringer et al. | 92/23 |
| 4,184,803 | 1/1980 | Housman | 414/694 |
| 4,227,852 | 10/1980 | Schmitz et al. | 414/694 |
| 4,260,320 | 4/1981 | Steiger | 414/680 |
| 4,260,321 | 4/1981 | Beauchamp et al. | 414/694 |
| 4,278,394 | 7/1981 | Johnson | 414/694 |
| 4,370,090 | 1/1983 | Shumacker et al. | 414/694 |
| 4,373,851 | 2/1983 | Confoey | 414/722 |
| 4,529,043 | 7/1985 | Jensen et al. | 172/776 |

*Primary Examiner*—Robert J. Spar
*Assistant Examiner*—D. Underwood
*Attorney, Agent, or Firm*—Andrus, Sceales, Starke & Sawall

[57] ABSTRACT

A lift arm lock down apparatus for a load lifting vehicle is described. The vehicle has a vehicle body and a lift arm or boom rotatable between a raised and a lowered position about a horizontal pivot on the vehicle body. The lift arm lock down apparatus includes a lock having first and second cooperating lock members for selectively locking the lift arm to the vehicle body in the lowered position. The lock members are respectively mounted on the lift arm and the vehicle body. At least one lock member is movable by an appropriate manually or automatically operated mechanism between an unlocked position permitting tilting of the lift arm and a locked position where the lock members are releasably interconnected when the lift arm is at the lowered position. The lift arm lock down apparatus prevents accidental lifting of the lift arm, when the operator is entering or exiting the operator's compartment and may be used as a theft deterrent when the lift arm is locked in a lowered, ground engaging position.

13 Claims, 3 Drawing Sheets

LIFT ARM LOCK DOWN APPARATUS AND METHOD

BACKGROUND OF THE INVENTION

1. Field of the Invention

This invention relates to lift arm structures for hydraulic load lifting vehicles and particularly to a lock down apparatus and method for securing one or more lift arms of a front end loader or boom lift in a lowered position.

2. Brief Description of the Prior Art

Front end loaders and boom lifts are generally operated through control levers, which actuate hydraulic control valves governing the supply of pressurized hydraulic fluid to various hydraulic cylinders and, in the case of hydraulically driven loaders and lifts, hydrostatic drives. These control levers are generally all placed within the operator's compartment and close to the operator's seat for easy access by the operator. As a result, it frequently occurs that an operator of such a hydraulic front end loader or boom lift, when getting into or leaving the operator's compartment, accidentally moves one or more of the control levers. Furthermore, as long as the motor of a hydraulic front end loader is running, the hydraulic liquid is normally maintained under pressure by a hydraulic pump driven by the motor. This means that, if the operator accidentally operates a control lever of the vehicle when exiting or entering the operator's compartment while the motor is running, the vehicle or parts thereof may be set into motion, which may lead to serious injury to the operator. This is especially the case in front end loaders of very compact construction such as, for example, skid steer loaders. In these loaders, the operator must climb over the lift arms of the loader boom or an implement affixed thereto in order to enter or exit the operator's compartment. Thus, an apparatus is required for front end loaders and boom lifts which secures at least one lift arm or boom in a lowered, preferably a ground engaging position, thereby preferably also preventing the loader vehicle from running away, especially since the operator may be required to repeatedly exit and re-enter the operator's compartment for maintenance and servicing of the machinery. The operator may also want to remotely operate the machinery or to operate attached equipment such as a backhoe from a separate operating station. If a loader type vehicle is equipped with a fork mounted on the lift arm or boom thereof for use of the vehicle as a fork lift, it is desirable, as a safety precaution, to lock the fork in a lowered position during manual loading of the fork. It may also be desired to lock the lift arm or an implement mounted thereon in ground engaging condition as a theft deterrent.

A bulldozer and backhoe boom lock down device is known from U.S. Pat. No. 4,373,851 by Confoey, which teaches a lock device including a split cylindrical sleeve, for installation around an extended cylinder rod of a hydraulic backhoe boom or bulldozer blade lifting cylinder. The sleeve may be locked in the installed condition. The sleeve is installed after the backhoe boom or bulldozer blade is forced against the ground by the lifting cylinder and prevents retraction of the cylinder rod into the cylinder, thus preventing the theft of the backhoe or bulldozer. It is a disadvantage that such a lock device cannot be employed for locking down a lift arm of a loader type vehicle, since the device may only prevent retraction of a hydraulic cylinder rod. Lift arm control cylinder rods of loader vehicles must generally be prevented from extending rather than retracting, if the lift arm is to be secured in a lowered position. It is a further disadvantage of such a locking device that the operator cannot install the locking device from within the operator's compartment, so that the operator is not protected when exiting the operator's compartment.

These disadvantages are overcome with a lift arm lock down apparatus and method in accordance with this invention, which provides for the locking of the lift arm of a front end loader or boom lift to the vehicle body in a lowered position of the lift arm. Thus, raising of the lift arm is substantially prevented. Furthermore, forward or backward movement of the vehicle is substantially prevented, if the lift arm or an implement attached thereto has been brought into engagement with the ground before being locked to the vehicle body. It is an advantage of a lift arm lock down apparatus in accordance with this invention, that it may be employed independently of whether the lifting cylinder rod of a lift arm to be locked down must be prevented from retracting or extending, since the lock down apparatus is independent of such a lifting cylinder rod and connects the lift arm itself with the vehicle frame or body.

SUMMARY OF THE INVENTION

Accordingly, the present invention provides a lift arm lock down apparatus for a load lifting vehicle having a vehicle body and a lift arm rotatable between a raised and a lowered position about a horizontal pivot on the vehicle body. The lock down apparatus includes a lock for selectively securing the lift arm to the vehicle body, when lowered. The lock includes means for releasably and, preferably, automatically connecting the lift arm to the vehicle body at a position remote from the pivot when the lift arm is lowered. The invention further provides a method for locking down a lift arm of a load lifting vehicle having a vehicle body and a lift arm rotatable between a raised and a lowered position about a horizontal pivot on the vehicle body, which method includes selectively fixing the lift arm to the vehicle body by means of a lock, when the lift arm is lowered.

In a preferred embodiment, the lock includes first and second lock members, which are respectively mounted on the lift arm and the vehicle body and positioned so that they are releasably interconnectable through a connecting means when the lift arm is lowered.

In another preferred embodiment at least one of the first and second lock members is selectively movable between an unlocked position allowing for tilting of the lift arm and a locked position where the connecting means releasably interconnects the first and second lock members when the lift arm is lowered.

In yet another preferred embodiment, the lock further includes a control means for moving the at least one movable lock member between the unlocked and locked positions. The control means preferably includes a handle which is easily operable by an operator of the loader vehicle from an operator's seat of the loader vehicle, and a linkage means connecting the handle with the movable lock member.

In a further preferred embodiment, the control means is provided with a biasing spring for selectively forcing the movable lock member into one of the unlocked and locked positions.

BRIEF DESCRIPTION OF THE DRAWINGS

The invention will now be further described by way of example only and with reference to the following drawings, wherein.

DESCRIPTION OF THE PREFERRED EMBODIMENTS

Figure 1:
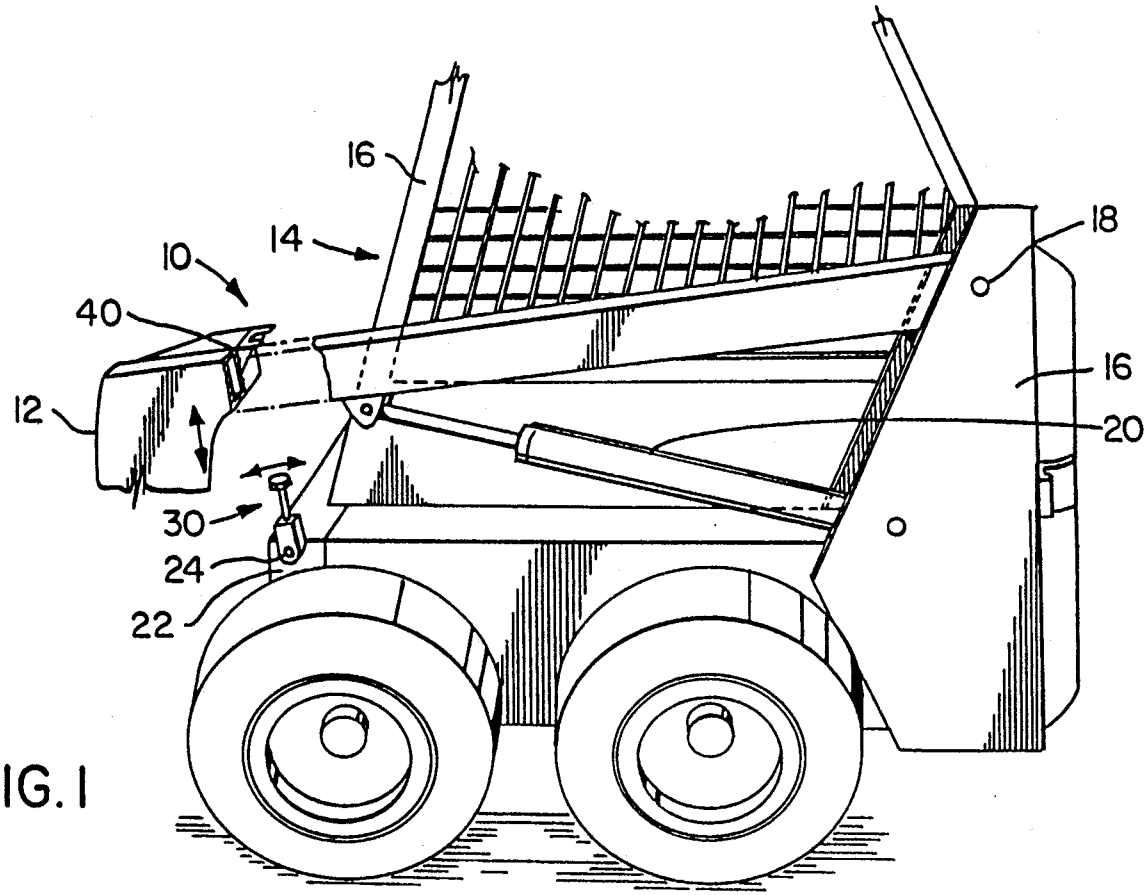
FIG. 1 illustrates a lift arm lock down apparatus in accordance with the invention mounted on a skid steer loader vehicle.
Figure 2:
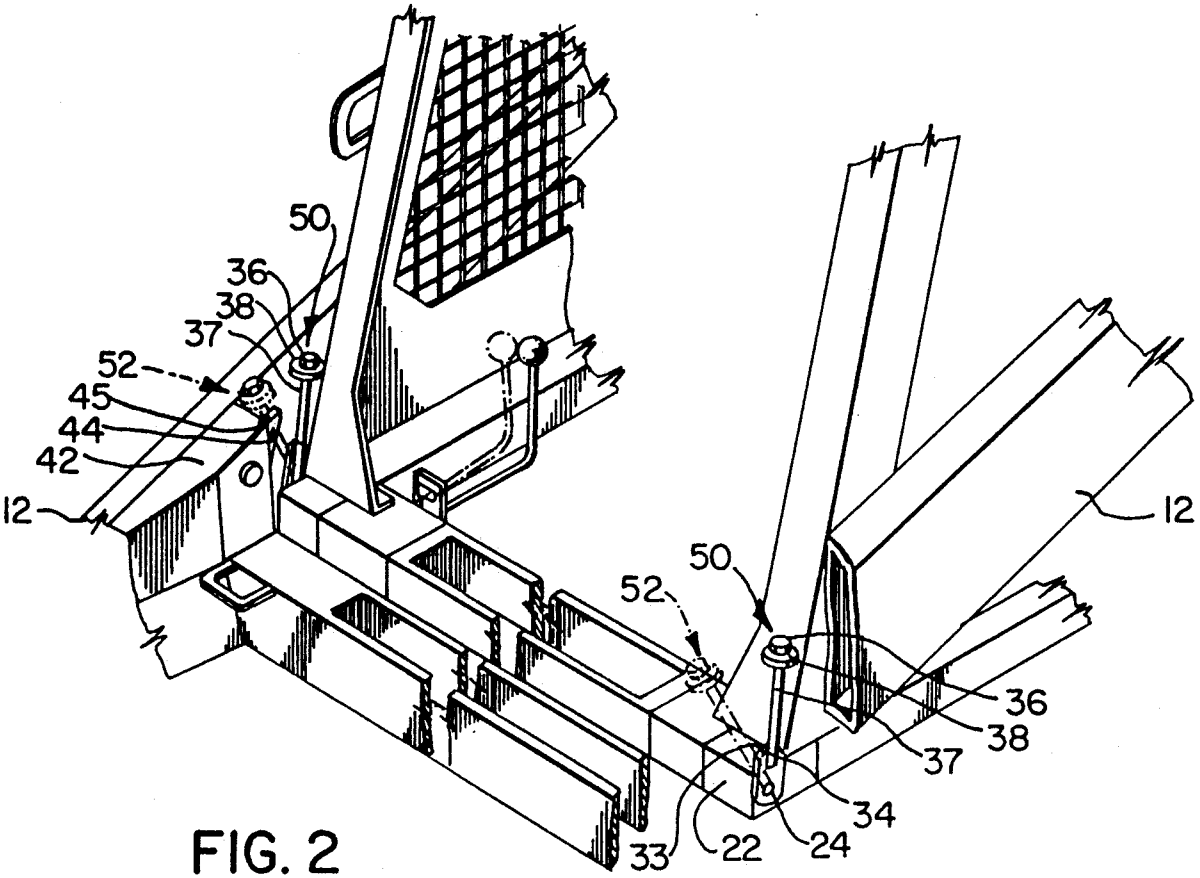
FIG. 2 illustrates an enlarged section of the skid steer loader vehicle and lock down apparatus shown in FIG. 1.

A lift arm lock down apparatus in accordance with the invention as illustrated in FIGS. 1 to 5 and in the following generally referred to by reference numeral 10, is preferably employed in a front end loader which includes a body 16 and at least one lift arm 12 rotatable about a pivot 18 on body 16. Lock down apparatus 10 includes a lock which has locking means to secure lift arm 12 when lowered as illustrated in FIG. 2.

In the preferred embodiment shown in FIG. 1, a lift arm lock down apparatus 10 in accordance with the invention is mounted on a skid steer loader 14. Lift arm cylinder 20 tilts lift arm 12 around pivot 18 on body 16. Lock down apparatus 10 includes a lock having first and second lock members 30 and 40, which are adapted to secure lift arm 12 to body 16 in a lowered position. It is readily appreciated that a front end loader generally includes a pair of lift arms 12 which are usually transversely connected remote from horizontal pivot 18 to form a boom and that the boom and each individual lift arm 12 may be secured to vehicle body 16 by a lock down apparatus 10. However, for reasons of simplicity, the construction and operation of lock down apparatus 10 will be described in the following mainly in connection with one lift arm only.

Figure 3:
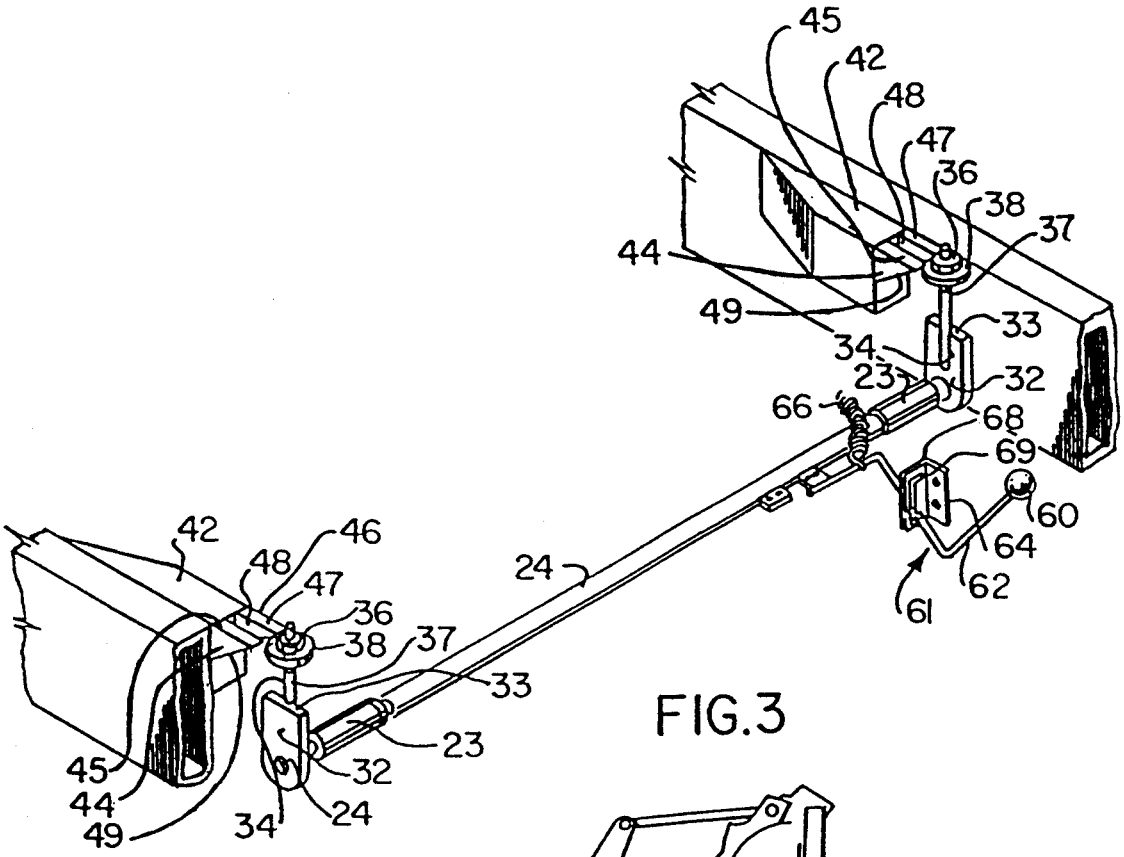
FIG. 3 shows the components of the lift arm lock down apparatus shown in FIG. 2.

Turning now to FIGS. 2 and 3, first lock member 30 (see FIGS. 1 and 4) includes a rod 34 rigidly affixed at one end to a vertical, elongated base plate 32 secured to one end of a horizontal shaft 24, and at its other threaded end it is provided with a lock nut 36 to which is welded a flat washer 38. Horizontal shaft 24 extends transversely to the longitudinal axis of the vehicle body and is rotatably mounted within an upper front beam 22 of the vehicle body by means of bearing sleeves 23 welded to beam 22. Second lock member 40 (see FIGS. 1 and 4) includes inner and outer triangular plates 44 and 46 which are at one side welded in parallel spaced apart relationship to a box section 42 fixed to lift arm 12. Parallel plates 44, 46 are sufficiently spaced apart to permit insertion of a neck portion 37 of rod 34 into a slot 48 formed therebetween. Neck portion 37 is that part of rod 34 located between flat washer 38 and an upper edge 33 of a base plate 32. Flat washer 38 has a diameter which is larger than the width of slot 48. First and second lock members 30, 40 are positioned along lift arm 12 so that lift arm 12 can be connected to body 16 through insertion of neck portion 37 into slot 48 when lift arm 12 is in a lowered position as illustrated in FIG. 2. A handle 60 is connected with shaft 24 through a linkage means, preferably a control rod 62 for the rotation of shaft 24, and thus, first locking member 30, between an unlocked position 50 and a locked position 52. Control rod 62 extends through a C-shaped slot 68 in a control rod guide 64, the arms 69 of C-shaped slot 68 being horizontal. Control rod guide 64 is so bolted to vehicle body 16 that control rod 62 is located at the closed end of one of arms 69 when rod 34 is in one of the unlocked and locked positions 50. 52. Thus, control rod guide 68 provides a guide means for holding control rod 62 and handle 60 in their corresponding positions. Handle 60 may be moved between first and second positions corresponding to the unlocked and locked positions 50 and 52 of rod 34 by pushing it first in a horizontal and subsequently in a vertical direction to move control rod 62 along C-shaped slot 68. To secure lift arm 12 in a lowered position, rod 34 affixed to base plate 32 is rotated through manipulation of handle 60 from unlocked position 50 permitting rotation of lift arm 12 to locked position 52. In locked position 52, neck portion 37 is located in slot 48 so that flat washer 38 engages the upper surfaces 45 and 47 of plates 44, 46. Thus, an upward movement of lift arm 12 with respect to vehicle body 16 is prevented. The ends of a coil spring 66 are respectively hooked to control rod 62 and vehicle body 16 in order to pull control rod 62 into the second position corresponding to locked position 52 when located in the vertical part of slot 68. Triangular plates 44, 46 have inclined front surfaces 49 along which flat washer 38 is guided to the plates' apex when rod 34 is in locking position 52 and the lift arm is being lowered. Once lift arm 12 reaches the lowered position, neck 37 is forced into slot 48 through spring 66. Thus, handle 60 may be operated to move rod 34 to locked position 52 when lift arm 12 is raised to provide for an automatic locking of the lift arm once it is lowered.

Figure 4:
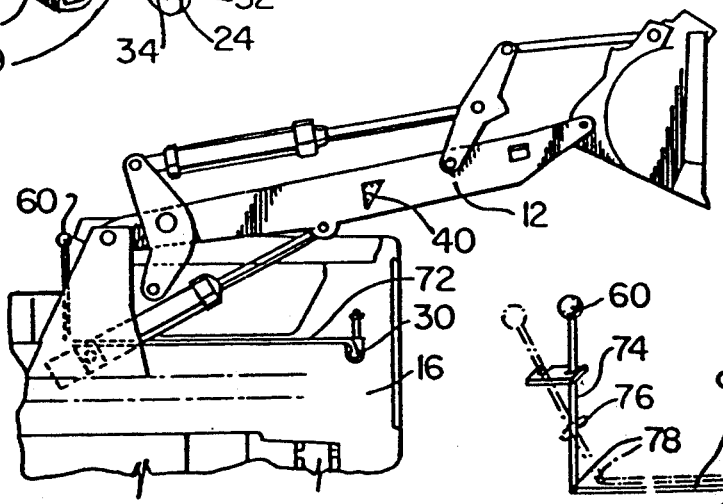
FIG. 4 illustrates a lock down apparatus in accordance with the invention mounted on a dozer type loader vehicle.
Figure 5:
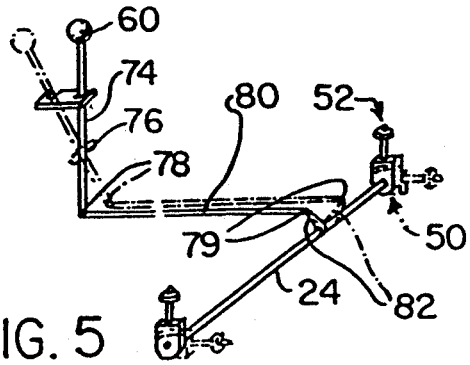
FIG. 5 illustrates the movable parts of the lift arm lock down apparatus shown in FIG. 4.

As is apparent from FIG. 4, a lift arm lock down apparatus in accordance with the invention may also be employed in other front end loaders than skid steer loaders. In fact, the lock down apparatus of the invention may be employed in any load lifting vehicle having one or more lift arms or booms mechanically or hydraulically rotatable about a horizontal pivot of the vehicle body for locking of the lift arm to the vehicle body in a lowered position. Suitable load lifting vehicles other than the above discussed skid steer loaders are, for example, dozer-type loader vehicles, and boom lifts or rough terrain fork lifts and lift trucks having a fixed or a telescopic boom. The appropriate placement of the lock along the lift arm or boom of such vehicles will be readily apparent to a person skilled in the art. The lock down apparatus shown in FIGS. 4 and 5 includes a lock having first and second lock members 30 and 40 respectively affixed to the body 16 and at least one of the lift arms 12 of a dozer type loader vehicle. In the preferred embodiment shown, handle 60 is mounted to one end of a control lever 74 which is rotatably mounted between its ends on a pivot 76. Control lever 74 is, with its other end, rotatably connected through a pivot 78 to a first link rod 80 which in turn is rotatably connected through a pivot 79 with a second link rod 82. Second link rod 82 is welded to either base plate 32 or shaft 24.

Apart from preventing lift arm 12 from accidental raising, a lock down apparatus in accordance with the invention may also be used as a theft deterrent. This is achieved by retaining an implement attached to the lift arm in a ground engaging position through fixing the lift arm 12 in a lowered position. Subsequently, rod 34, shaft 24 or, preferably, control rod 62 are locked so that a disengagement of neck 37 from slot 48 is prevented. To this end, control rod 62 is retained at the end of the appropriate arm of C-shaped slot 68 by means of a padlock so that a movement of control rod 62 along C-shaped slot 68 is prevented.

Although the above described embodiments are the preferred embodiments of a lock down apparatus in accordance with the invention, other constructions are readily apparent to a person skilled in the art. For example, a skilled person will appreciate that the first and second lock members which are the preferred locking means in accordance with the invention as well as the control means may be manufactured separately for their subsequent mounting to the body and lift arm of a front end loader. Also, shaft 24 may be omitted and each first lock member 30 may be individually provided with a control means including, for example, a handle 60 and a control rod 62. Furthermore, the lock may include a second lock member 40 constructed as a chain secured to lift arm 12 and a first lock member 30 in the form of a chain-link lock, or a hook affixed to vehicle body 16 for engaging and releasably retaining a link of the chain. Second lock member 40 may also be constructed as an eyelet affixed to lift arm 12. First lock section 30 may be a hook rotatably mounted on vehicle body 16 and adapted to engage the eyelet when the lift arm is lowered. In another embodiment, second lock member 40 may be constructed as described in connection with FIGS. 1 to 5 and first lock section 30 may be a T-shaped base plate which is rotatable in a vertical plane, mounted on vehicle body 16 and adapted to engage slot 48 with its upright portion and prevented from sliding through slot 48 by a transversely oriented terminal crossbar. In a further embodiment, the base plate 32 may be flat and may have a transversely extending first bore and lateral plates 44, 46 may be provided with a transverse second bore, which bores are co-extensive when the lift arm is in a lowered position permitting the insertion of a locking means, in form of a locking pin. In yet another embodiment, the lock may include a first bore extending through vehicle body 16 from the operator's compartment of a loader vehicle towards a lift arm or a transverse beam connecting a pair of lift arms. The lift arm or the transverse beam may be provided with a second bore in such a way that the first and second bores are co-extensive when the lift arm or beam is in a lowered position. This permits the insertion of a locking pin into the bores in order to secure the lift arm or arms in the lowered position. That end of locking pin which is adapted to engage the lift arm or the transverse beam may be obliquely cut and the locking pin may be spring biased to permit an automatic locking of lift arm 12 in the lowered position. In yet another embodiment, inner and outer lock plates 44, 46 may be combined into a single block. Accordingly, first lock section 30 may be constructed as a downwardly directed hook rotatably mounted on vehicle body 16 and adapted to engage the single block, which may be provided on its top surface, with a small recess for engagement by the tip of the hook. It will also be readily apparent to a person skilled in the art that handle 60 may be connected with first lock section 30 or shaft 24 through a linkage means in form of a lever, a sliding bar or any other appropriate movable link. It will be further apparent to a person skilled in the art that the handle or handles may be manually, automatically or remotely operated, for example, through a solenoid or a rotating cam mechanism. For example, the control means may be provided with a hydraulic or pneumatic actuator, which may be activated by the operator through a manual lever or an electric switch. The operation of the control means may also be fully automatic and controlled by electric or electronic means sensing the weight of an operator on the operator's seat. The control means may further be connected to the hydraulic control valve of the lift arm so that the lift arm is automatically lowered and locked at the lowered position when the operator leaves the operator's seat. All the components of a lift arm lock down mechanism in accordance with the invention may be provided separately or as a kit for installation in any front end loader. Finally, a lock down mechanism in accordance with the invention may be installed in front end loaders having a removable front loader system, for example, farm tractors.

Changes and modifications in the specifically described embodiments can be carried out without departing from the scope of the invention which is intended to be limited only by the scope of the appended claims.

We claim:

1. A lift arm lock down apparatus for retaining a lift arm of a front end loader vehicle in a lowered position, the vehicle including a vehicle body and a lift arm mounted to a horizontal pivot on the vehicle body for rotation between a raised and a lowered position, comprising:

first and second lock members; the first lock member being affixed to said lift arm and having a slot and the second lock member having opposite ends and an intermediate neck portion for engaging the slot, the second lock member being pivotally affixed on one said end to said vehicle body, the opposite end including a stop means for preventing a movement of the neck portion through the slot, the first and second lock members being respectively affixed to said lift arm and said vehicle body at a position remote from said horizontal pivot of said lift arm so that when the lift arm is in the lowered position the first and second lock members are releasably interconnectable through selected rotation of the second lock member from an unlocked position permitting movement of said lift arm between the raised and the lowered position to a locked position wherein said neck portion engages said slot when the lift arm is in the lowered position and said stop means prevents said neck portion from sliding through said slot thereby retaining the lift arm in the lowered position.

2. A lift arm lock down apparatus as defined in claim 1, further comprising a control means from selectively moving said second lock member from the unlocked to the locked position, the control means including a control lever movable between first and second positions and the second lock member being affixed to the control means so that the second lock member is moved from the unlocked to the locked position upon movement of the control lever from the first to the second position and vice versa.

3. A lift arm lock down apparatus as defined in claim 2, wherein said control means includes biasing means for selectively forcing the second lock member into one of said unlocked and locked positions, the biasing means being respectively mounted to the vehicle body and the control lever.

4. A lift arm lock down apparatus as defined in claim 2, wherein said control means includes a handle affixed to the control lever, the handle being constructed to be operable from an operator's seat of said front end loader vehicle.

5. A lift arm lock down apparatus as defined in claim 4. further comprising a control lever guide means for controlling a movement of the control lever between the first and second positions, the guide means having means for selectively retaining the control lever in one of the first and second positions, thereby retaining the second lock member in one of said unlocked and lock positions.

6. A lift arm lock down apparatus as defined in claim 2, wherein the control means includes a control rod rotatably mounted to the vehicle body and the control lever affixed to the control rod, the second lock member having opposite ends and being at one end affixed to the control rod for pivotal movement between the locked and unlocked positions and the control lever being positioned on the control rod to be accessible from within an operator's compartment of the vehicle.

7. A lift arm lock down apparatus as defined in claim 1, further comprising means for automatically moving the second lock member to the locked position when the lift arm is in the lowered position, the means for automatically moving the second lock member including biasing means for forcing the second lock member into the locked position and the first lock member having a cam surface for guiding the stop means around the first lock member when the lift arm is moved to the lowered position, the cam surface being positioned in the path f the stop means so that the neck portion of the second lock member is engageable with the slot of the first lock member when the lift arm is in the lowered position.

8. A lift arm lock down apparatus as defined in claim 7, wherein the second lock member is affixed to and pivotal around a horizontal shaft mounted to the vehicle body and a control lever is affixed to the horizontal shaft, the biasing means being a coil spring having opposite ends respectively affixed to the vehicle body and the control lever and being tensioned for forcing the second lock member into the locked position.

9. A lift arm lock down apparatus as defined in claim 1, wherein the first lock member is a plate having a pair of parallel side surfaces, the plate being affixed along one of the side surfaces to the lift arm and having in the other side surface a slot for receiving the neck portion of the second lock member.

10. A lift arm lock down apparatus as defined in claim 9, wherein the second lock member is a rod having a diameter smaller than the width of the slot, the rod being at one of the pair of opposite ends affixed to a control rod pivotally mounted to the vehicle and having a threaded portion at the other end, the stop means engaging the threaded portion and having a larger width than the slot of the first lock member.

11. A lift arm lock down apparatus as defined in claim 10, wherein the stop means is a nut and washer combination engaging the threaded portion of the rod, at least the washer having a diameter larger than the width of the slot of the first lock member.

12. A front end loader vehicle, comprising:

a vehicle body;

a lift arm mounted to a horizontal pivot on the vehicle body for rotation between a raised and a lowered position;

means for selectively raising the lift arm; and a lift arm lock down apparatus for retaining the lift arm in the lowered position, the lock down apparatus including first and second lock members; the first lock member being affixed to the lift arm and having a slot and the second lock member having a pair of opposite ends and an intermediate neck portion for engaging the slot, the second lock member being pivotally mounted at one of the ends to the vehicle body and having at the other end a stop means for substantially preventing a sliding of the neck portion through the slot, the first and second lock members being respectively affixed to the lift arm and the vehicle body at a position remote from the horizontal pivot so that when the lift arm is in the lowered position the first and second lock members are releasably interconnectable through selective movement of the second lock member from an unlocked positron permitting movement of the lift arm between the raised and lowered positions to a locked position wherein the neck portion engages the slot of the first lock member and the stop means prevents the neck portion from sliding through the slot thereby retaining the lift arm in the lowered position.

13. A vehicle as defined in claim 12, further comprising an implement attached to a front end of the lift arm, the first and second lock members being respectively positioned on the lift arm and the vehicle body so that the implement is maintained in a ground engaging condition for preventing the vehicle from running away when the lift arm is retained in the lowered position.

* * * * *

UNITED STATES PATENT AND TRADEMARK OFFICE

CERTIFICATE OF CORRECTION

PATENT NO. : 5,169,277

DATED : December 8, 1992

INVENTOR(S) : LLOYD ORSER ET AL

It is certified that error appears in the above-identified patent and that said Letters Patent is hereby corrected as shown below:

Claim 7, col. 7, line 37, delete "f" and substitute therefor ---of---; Claim 10, col. 8, line 7, after "vehicle" insert ---body---; Claim 12, col. 9, line 39, after "unlocked" delete "positron" and substitute therefor ---position---

Signed and Sealed this

Twenty-second Day of March, 1994

Bruce Lehman

*Attest:*

BRUCE LEHMAN

*Attesting Officer*

*Commissioner of Patents and Trademarks*